US005449272A

United States Patent [19]

Boyd et al.

[11] Patent Number: 5,449,272

[45] Date of Patent: Sep. 12, 1995

[54] MOUNTING APPARATUS FOR A NOZZLE GUIDE VANE ASSEMBLY

[75] Inventors: Gary L. Boyd, Alpine, Calif.; James E. Shaffer, Maitland, Fla.

[73] Assignee: Solar Turbines Incorporated, San Diego, Calif.

[21] Appl. No.: 171,807

[22] Filed: Dec. 22, 1993

[51] Int. Cl.[6] ..... F04D 29/60

[52] U.S. Cl. ..... 415/209.2; 415/200; 415/209.3

[58] Field of Search ..... 415/189, 190, 200, 209.2, 415/209.3

[56] References Cited

U.S. PATENT DOCUMENTS 2,982,519 5/1961 Haworth et al. ..... 415/209.4
3,867,065 2/1975 Schaller et al. ..... 415/209.4
4,391,565 7/1983 Speak ..... 415/189
4,759,687 7/1988 Miraucourt et al. ..... 415/209.3
4,768,924 9/1988 Carrier et al. ..... 415/189
5,176,496 1/1993 Correia et al. ..... 415/209.2

*Primary Examiner*—John T. Kwon
*Attorney, Agent, or Firm*—William C. Perry

[57] ABSTRACT

The present invention provides a ceramic nozzle guide assembly with an apparatus for mounting it to a metal nozzle case that includes an intermediate ceramic mounting ring. The mounting ring includes a plurality of projections that are received within a plurality of receptacles formed in the nozzle case. The projections of the mounting ring are secured within the receptacles by a ceramic retainer that allows contact between the two components only along arcuate surfaces thus eliminating sliding contact between the components.

15 Claims, 4 Drawing Sheets

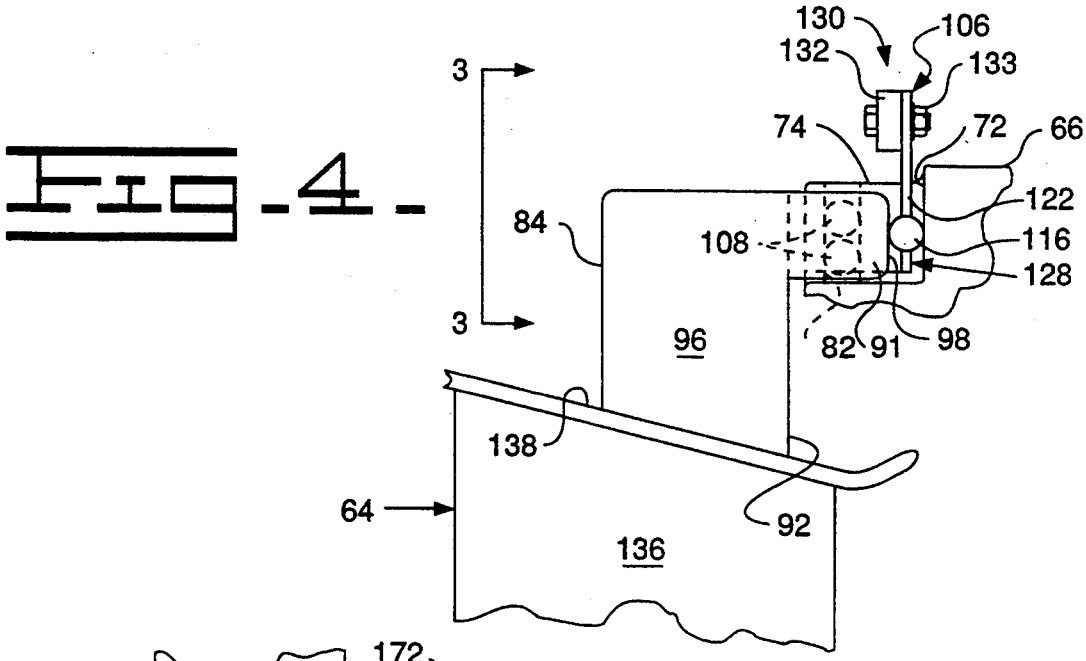
Fig-4-
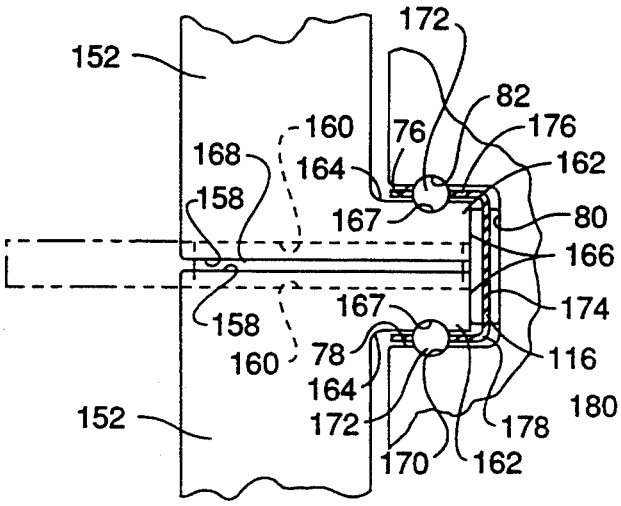
Fig-5-
Fig-6-
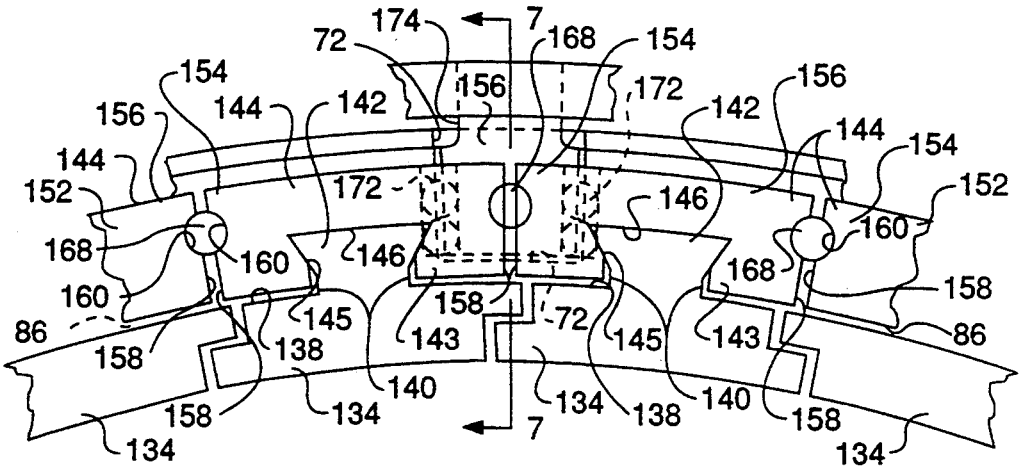

MOUNTING APPARATUS FOR A NOZZLE GUIDE VANE ASSEMBLY

"The Government of the United States of America has rights in this invention pursuant to Contract No. DE-AC02-92CE40960 awarded by the U.S. Department of Energy".

TECHNICAL FIELD

This invention relates generally to a gas turbine engine and more particularly to the mounting of a ceramic nozzle guide vane assembly to a nozzle case.

BACKGROUND ART

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

In order to produce a driving torque, the axial turbine consists of one or more stages, each employing one row of stationary nozzle guide vanes and one row of moving blades mounted on a turbine disc. The nozzle guide vanes are aerodynamically designed to direct incoming gas from the combustion stage onto the turbine blades and thereby transfer kinetic energy to the blades.

The gases typically entering the turbine have an entry temperature from 850 degrees to at least 1200 degrees Fahrenheit. Since the efficiency and work output of the turbine engine are related to the entry temperature of the incoming gases, there is a trend in gas turbine technology to increase the gas temperature. A consequence of this is that the materials of which the blades and vanes are made assume ever-increasing importance with respect to resisting the effects of elevated temperatures.

Historically, nozzle guide vanes and blades have been made of metals such as high temperature steels and, more recently, nickel alloys, and it has been found necessary to provide internal cooling passages in order to prevent melting. It has been found that ceramic coatings can enhance the heat resistance of nozzle guide vanes and blades. In specialized applications, nozzle guide vanes and blades are being made entirely of ceramic material, thus, imparting resistance to even higher gas entry temperatures.

However, if the nozzle guide vanes and/or blades are made of ceramic material, they will have a different chemical composition, physical properties and coefficient of thermal expansion than that of a metal supporting structure. As a result, undesirable stresses, a portion of which is thermal stress, will be set up between the ceramic components and their respective supports when the engine is operating. Such undesirable thermal stresses cannot adequately be contained by cooling.

Furthermore, conventional joints between ceramic and metallic components result in highly stressed joints. The sliding friction between the ceramic and the metallic components creates a contact tensile stress on the ceramic material that degrades the surface. This degradation in the surface of the ceramic material creates a critical tensile stress zone. Therefore, when a surface flaw of critical size is generated in the ceramic component, it will fail catastrophically.

The present invention is directed to overcoming one or more of the problems as set forth above.

DISCLOSURE OF THE INVENTION

In one aspect of the present invention, a mounting apparatus for a plurality of ceramic nozzle guide vanes is provided. The mounting apparatus includes a metallic nozzle case having a plurality of receptacles formed in an end face thereof, said nozzle case being positioned axially along a centerline that extends therethrough. A plurality of ceramic nozzle guide vanes is also provided, each having a connecting portion defined on an outer circumference thereof. A ceramic mounting ring is included that has an inner diameter that defines a plurality of connecting portions and a plurality of axially extending projections. The connecting portions of the mounting ring are sufficient to engage the connecting portions of the nozzle guide vanes to secure the nozzle guide vanes to the mounting ring. The axially extending projections are sufficient for positioning within the respective receptacles formed in the nozzle case. A means for retaining the axial projections within the receptacles is included in the invention.

In another aspect of the present invention, a mounting apparatus is provided for a nozzle guide vane assembly that includes a nozzle case that is positioned along a centerline of an engine. The nozzle case has a radially extending end face that defines at least three radially disposed receptacles equally spaced thereon. The nozzle case is constructed of material having a preselected rate of thermal expansion. A plurality of nozzle guide vane segments are provided that have a connecting portion defined on an outer circumferential surface. The nozzle guide vane segments are constructed of a material that has a preselected rate of thermal expansion that is less than that of the nozzle case. A mounting ring is included that has an inner diameter that defines a plurality of connecting portions and a plurality of axially extending projections. The connecting portions are sufficient to engage the connecting portions of the nozzle guide vanes to secure the nozzle guide vanes thereto. The axially extending projections are sufficient for positioning within the respective receptacles formed in the nozzle case. The mounting ring is constructed of a material that has a preselected rate of thermal expansion that is substantially equal to that of the nozzle vane segments. A means for retaining the axial projections within the receptacles is provided. The retaining means has a preselected rate of thermal expansion that is substantially equal to that of the nozzle vane segments.

BRIEF DESCRIPTION OF THE DRAWINGS

FIG. 4 is an enlarged side view of the connection between the mounting ring and the nozzle case taken along lines 4—4 of FIG. 2;

FIG. 5 is an enlarged view of an alternate embodiment of a mounting ring and its connection with the nozzle case similar to that of FIG. 2;

FIG. 6 is an enlarged front view of the connection between the mounting ring and the nozzle case similar to that shown in FIG. 3 taken along line 6—6 in FIG. 7;

BEST MODE FOR CARRYING OUT THE INVENTION

Figure 1:
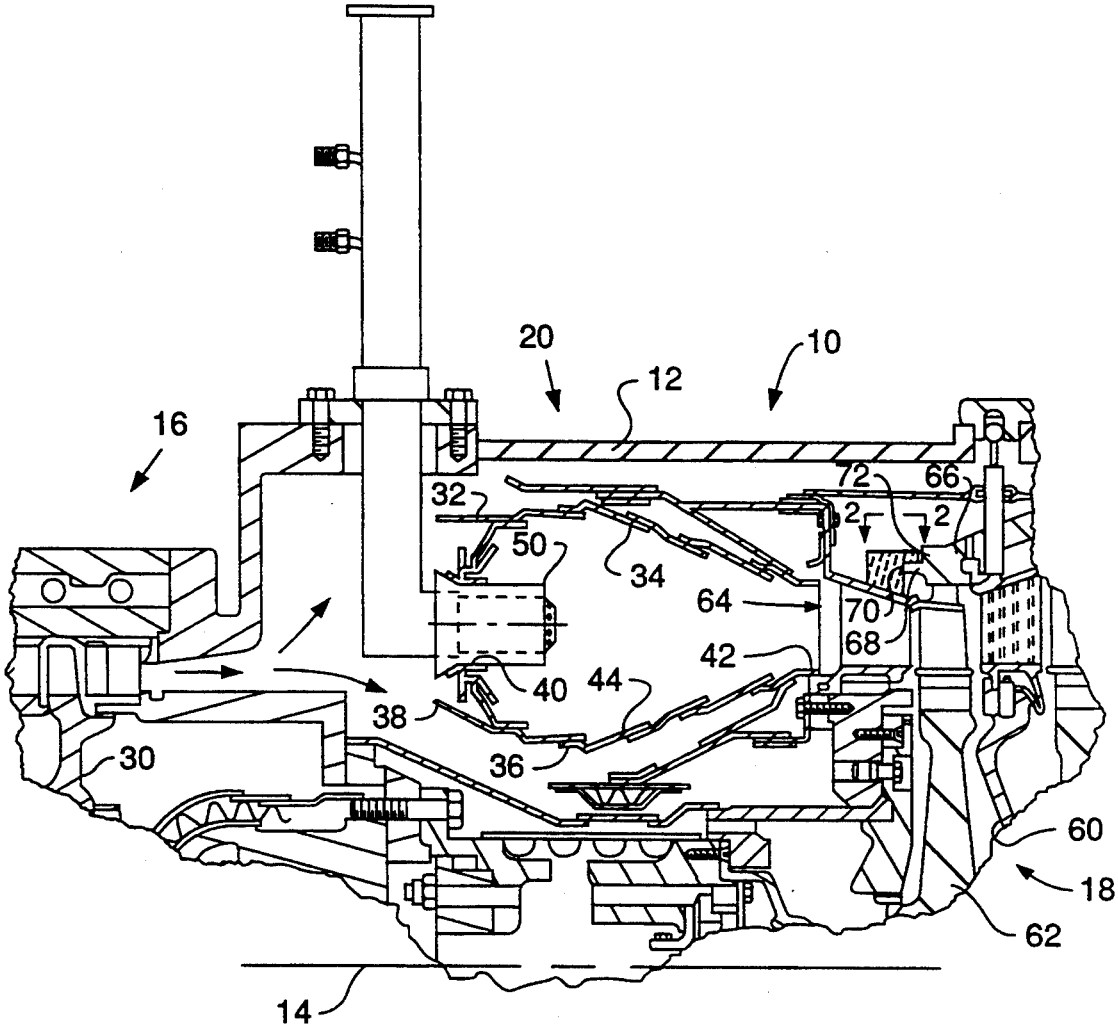
FIG. 1 is a partial side view of a gas turbine engine embodying the principles of the present invention with portions shown in section for convenience of illustration.

Referring to FIGS. 1–4, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30 or, as an alternative, a radial compressor or any source for producing compressed air, causes a flow of compressed air which has at least a part thereof communicated to the combustor section 20. The combustor section 20, in this application, includes an annular combustor 32. The combustor 32 has a generally cylindrical outer shell 34 being coaxially positioned about the central axis 14, a generally cylindrical inner shell 36, an inlet end 38 having a plurality of generally evenly spaced openings 40 therein and an outlet end 42. In this application, the combustor 32 is constructed of a plurality of generally conical segments 44. Each of the openings 40 has an injector 50 positioned therein. As an alternative to the annular combustor 32, a plurality of can-type combustors could be incorporated without changing the essence of the invention.

The turbine section 18 includes a power turbine 60 having an output shaft, not shown, connected thereto for driving an accessory component such as a generator. Another portion of the turbine section 18 includes a gas producer turbine 62 connected in driving relationship to the compressor section 16. Positioned between the outlet end 42 of the combustor 32 and the gas producer turbine 62 is a ceramic nozzle guide vane assembly 64. The nozzle guide vane assembly 64 is a stationary assembly of blades that are curved at an optimum angle so that the air flow that passes therethrough will be directed against the gas producer turbine having a maximum impact against the blades and cause it to rotate. The nozzle guide vane assembly is suspended from a metallic nozzle case 66 that encompasses the turbine section 18.

Figure 2:
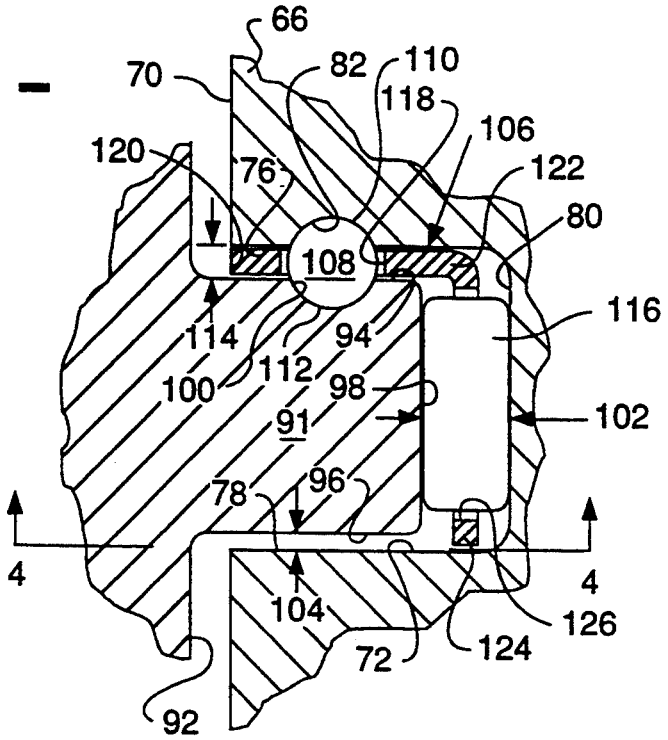
FIG. 2 is an enlarged view of the connection between the mounting ring and the nozzle case taken along lines 2—2 in FIG. 1.
Figure 3:
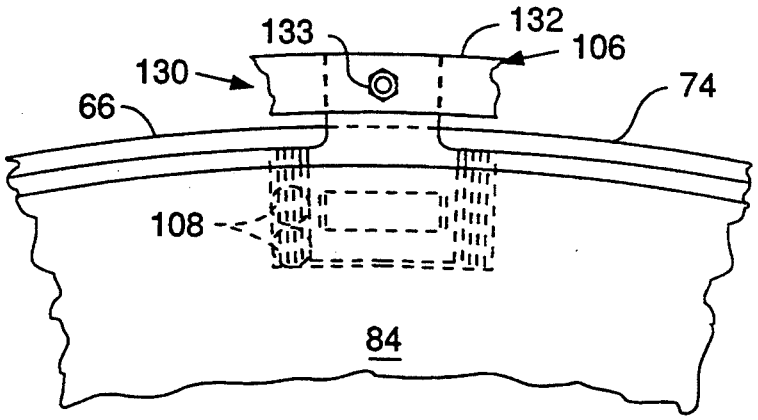
FIG. 3 is an enlarged front view of the connection between the mounting ring and the nozzle case taken along lines 3—3 in FIG. 4.

The nozzle case has an innermost end portion 68 that terminates in a circular, radially extending end face 70. Three identical receptacles 72 (one shown) are equally, positioned (120 degrees apart) about the end face 70. As is best shown in FIGS. 2 and 4, each receptacle 72 is positioned to open onto a circumferentially outer surface 74 of the nozzle case 66. A first and second axially directed sidewall, 76 and 78 respectively, extends inwardly from the end face 70 and are positioned in spaced relationship to one another. The first and second sidewalls are connected by a third sidewall 80 that is spaced axially from the end face 70 of the nozzle case. A radially extending groove 82 is defined in the first sidewall at a preselected position between the end face 70 and the third sidewall 80.

A ceramic mounting ring 84 is positioned intermediate the nozzle guide vane assembly 64 and the nozzle case 66 and may be an integral portion of the nozzle guide vane assembly or it may be a separate member that is connected to the mounting ring in a manner to be described hereinafter. In the preferred embodiment, the mounting ring is circular in configuration and has an outer diameter that is approximately equal to that of the end face 70 of the nozzle case. A plurality of projections 91 are positioned about the mounting ring and extend from a first or outer face 92 defined by the mounting ring. While the disclosure utilizes three projections that are spaced 120 degrees apart about the circumference of the mounting ring, it is to be understood that any other suitable number of projections may be used without departing from the intent of the invention. The projections are formed having a first and second sidewall, 94 and 96 respectively, that are spaced from and parallel to one another and extend in an axial direction. The first and second sidewalls are connected by a third sidewall 98 that is spaced axially from the mounting ring and extends in a direction normal to the first and second sidewalls. The first sidewall 94 further defines a radially extending groove 100 that is positioned a preselected distance between the outer face 92 of the mounting ring and the third sidewall 98. The spacing between the first and second sidewalls, 94 and 96 respectively, is such that the projections are of a size sufficient for insertion into the respective receptacles 72 formed in the nozzle case. The respective first, second and third sidewalls 94, 96, and 98 of the projections are positioned in spaced parallel relationship to the respective sidewalls 76, 78, and 80 of the receptacles 72. When so positioned, the grooves 82 and 100 that are defined in the respective first side walls 76 and 94 receptacles and projections are positioned in registry with one another. A space 102 is created between the third sidewalls 98 of the projections and the third sidewalls 80 of the receptacles. The second sidewalls 96, which are generally planar, are positioned in closely adjacent relationship to the second sidewalls 78 of the receptacles a preselected distance to create a space 104, as shown in FIG. 2. It is to be understood that while the projections 91 have been described as being formed on the mounting ring and the receptacles have been described as being formed in the nozzle case, the positioning of these components could be reversed without departing from the intent of the invention.

The positioning of the projections 91 within the receptacles 72, and thus the attachment of the mounting ring to the nozzle case is maintained by a retaining means 106. The retaining means 106 includes a first member 108, which may take the form of a plurality of balls or other suitable roller member, is positioned between the aligned grooves 82 and 100 in each of the respective receptacles and projections. In the illustrated embodiment, a ball or plurality of balls 108, is shown positioned between the aligned grooves 82 and 100 and defines a first arcuate surface 110 that is engaged with the groove 82 and a second arcuate portion 112 that is engaged with the groove 100. The diameter of the balls 108 is such that the first sidewalls 76 and 94 of the respective receptacles 72 and the projections 91 are held a preselected distance apart, the preselected distance being indicated at 114 in FIG. 2. A second member of the retaining means 106 includes a roller or other cylindrical member 116. In the illustrated embodiment, a roller 116 is positioned in the space 102 defined between the third sidewalls 80 and 98 of each the respective receptacles 72 and projections 91. The roller is sized sufficiently to bridge the space 102 and maintain rolling contact with the respective third sidewalls 80 and 98. The balls 108 are mounted within an opening 118 defined in a first flange 120 of a cage member 122. A second flange 124 of the cage member 122 is connected to the first flange 120 and is positioned at a right angle thereto. The second flange 124 defines an opening 126 that is sufficient to mount the roller 116 therein. The first and second flanges 120 and 124 respectively, form a first or radially inner portion 128 (FIG. 4) of the cage member that is positioned within the receptacles between the respective sidewalls thereof and the projections. A second or radially outer portion 130 of the cage extends from the inner portions 128 to a position that is radially outward of the receptacles 72. The outer portion 130 of each cage member engages a positioning ring 132 that has a diameter sufficient for encompassing the entire nozzle case. The positioning ring 132 is attached to each of the cage members in any suitable fashion, such as a threaded fastener 133 (FIG. 4) and maintains the position of all the retaining means 106 within their respective receptacles.

Figure 7:
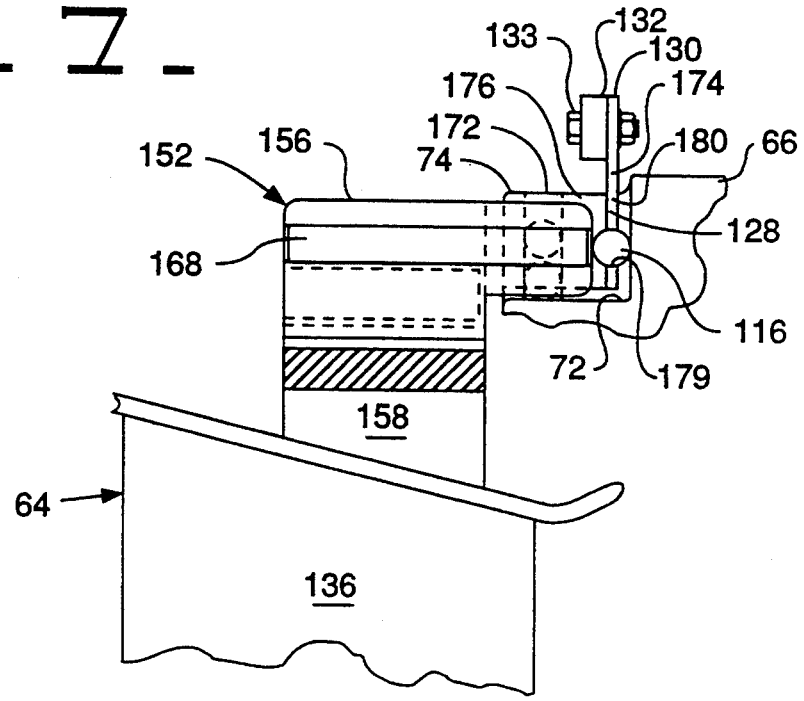
FIG. 7 is an enlarged side view of the connection shown in FIG. 5 taken along lines 7—7 of FIG. 6.

An alternate apparatus is set forth in FIGS. 5–7 and it is to be understood that identical components that appear in both embodiments of the present invention will retain common reference numerals for the sake of clarity. The alternate embodiment includes a nozzle guide vane assembly that is formed by a plurality of ceramic segments 134. The segmented nozzle guide vane assembly may define a single or a plurality of curved blade portions 136 depending upon the size of the individual segments. Each segment defines an outwardly facing, circumferential surface 138 from which an upstanding flange 140 extends. The upstanding flange 140 defines a connecting portion 142 that is sufficient to engage a plurality of connecting portions 143 defined on an inner diameter of a segmented mounting ring 144 that will be described in greater detail hereinafter. In the illustrated embodiment, the upstanding flanges 140 of the connecting portions are shaped in a dovetailed taper 145 that nest within complimentary shaped dovetailed grooves 146 defined by the connecting portions 143 of the mounting ring 144. When fully assembled, the nozzle guide vanes are evenly positioned about the central axis 14 of the turbine engine 10 and are suspended from the inner diameter 86 of the mounting ring.

The segmented ceramic mounting ring 144 is positioned between the nozzle guide vane segments 134 and the nozzle case 66 and is comprised of a plurality of individual segments 152 that define a first and second end portion 154 and 156 respectively, and are spaced circumferentially about the central axis 14 with the respective first and second end portions positioned adjacent one another. Each end portion is essentially the same as the other and each defines an axially extending first sidewall 158 that, in turn, defines a centrally disposed, axially directed groove 160. A portion of each of the first sidewalls forms a projection portion 162 that extends outwardly, or rightwardly as viewed in FIG. 1, from the mounting ring segments. A second sidewall 164 is radially spaced from the first sidewall 158 and forms an outer extremity of the projection portion 162. A third sidewall 166 joins the respective first and second sidewalls. The second sidewalls 164 of each segment define a radially extending groove 167. The segments are positioned in a manner to place the first sidewall 158 of one segment in face-to-face relationship with the first sidewall 158 of the adjacent segment with the respective axially extending grooves 160 in registry with one another. A cylindrical pin 168 is positioned in bridging contact with the aligned grooves 160 and is of sufficient diameter to maintain the segments in spaced, non-contacting relationship to one another. Since the projection portions 162 of each segment are positioned adjacent each other their combined width forms a projection that is sufficient to insert into the receptacles 72 formed in the nozzle case.

As in the preferred embodiment, each receptacle defines a first, second and third sidewall 76, 78, and 80 respectively. In addition to the radially extending groove 82 that is positioned in the first sidewall 76, another radially extending groove 170 is positioned in the second sidewall 78. The grooves are positioned axially along the first and second sidewalls at a location that will place them in registry with the grooves 167 of the adjacent second sidewalls 164 of the respective projection portions 162. A roller member in the form of a plurality of balls 172 or a pair of cylindrical pins is positioned within the aligned grooves 167 and 82, 170 on opposite sides of the projection portion 162 and lock the projection portions from axial movement with respect to the receptacles. A roller 116 is positioned between the third sidewall 166 of the projection portions 162 and the third sidewall 80 of the receptacle 72.

A cage member 174 has a radially inner portion 128 that defines first and second flanges, 176 and 178 respectively, that capture the balls 172. The roller 116, in turn, is captured within an opening 179 defined by a third flange 180 that extends between the first and second flanges of the cage member. A radially outer portion 130 extends from the inner portion in the same manner as described in the preferred embodiment and is mounted to a positioning ring 132 to maintain the positioning of the respective retaining means 106 within their respective receptacles 72.

Figure 8:
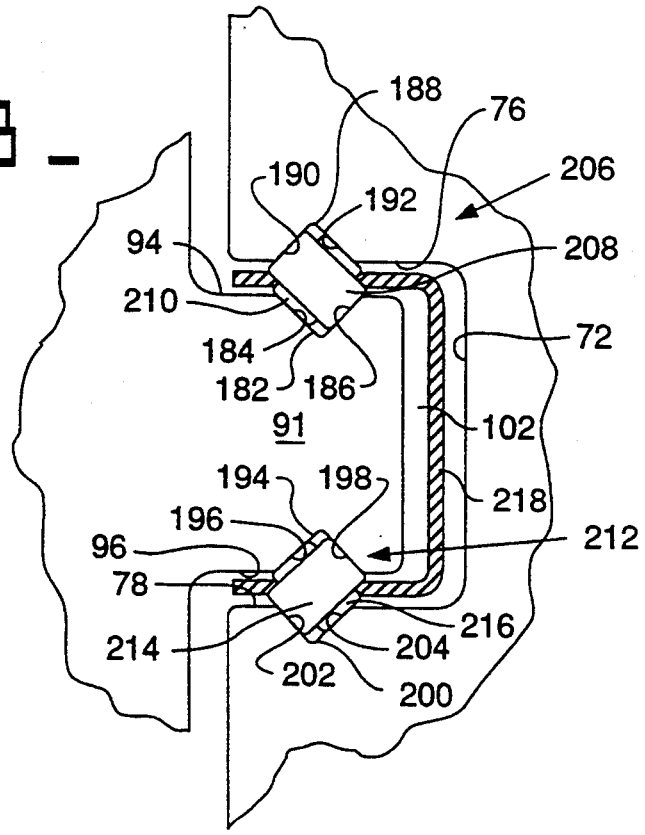
FIG. 8 is an enlarged view of another alternate embodiment of a mounting ring and its connection with the nozzle case similar to that shown in FIGS. 2 and 5.

Yet another alternate embodiment is disclosed in FIG. 8 wherein a projection, similar to projection 91, is shown positioned in a receptacle 72. As in FIG. 2, the first and second sidewalls 94 and 96 of the projection 91 are positioned adjacent the first and second sidewalls 76 and 78 respectively defined by the receptacle. The first sidewall of the projection defines a V-shaped groove 182 that defines first and second surfaces 184 and 186. The groove 182 is positioned for alignment with a V-shaped groove 188 that is defined in the first side wall 76 of the receptacle. Likewise, the groove 188 defines first and second surfaces 190 and 192 that are positioned to face in opposition to the surfaces 184 and 186. In a similar fashion, a V-shaped groove 194 is defined in the second sidewall 96 of the projection and forms first and second surfaces 196 and 198. A V-shaped groove 200 is defined in the second sidewall 78 of the receptacle 72 and defines first and second surfaces 202 and 204 respectively, that are positioned to face in opposition to the surfaces 196 and 198 of the groove 194. It can be seen that a compound roller member 206 is positioned within the aligned grooves 184 and 188 and has a first rolling element 208 in rolling contact with opposed surfaces 186 and 190, while a second rolling element 210 is in rolling contact with opposed surfaces 182 and 192. Another compound rolling element 212 is positioned within the aligned grooves 194 and 200 and has a first rolling element 214 in rolling contact with opposed surfaces 198 and 202 and a second rolling element 216 that is in rolling contact with opposed surfaces 196 and 204. With this arrangement, growth in the circumferential and axial directions may be accommodated by the respective rolling elements 206 and 212 without the requirement for a third roller between the respective third sidewalls 80 and 98 of the receptacles 72 and the projections 91. While shown without a roller in the space 102, it is to be understood that one may be positioned in the space to function as previously described without departing from the intent of the present invention. The compound rolling elements 206 and 212 are maintained in position by a cage member 218 that functions in a manner that is similar to that of cage members 122 and 174 described in the previous embodiments. The compound rolling elements may be any of a well known variety of roller assemblies that have a pair of rolling elements that are positioned to roll about individual axes that are located 90 degrees apart.

INDUSTRIAL APPLICABILITY

In use, the gas turbine engine 10 is started and allowed to warm up and is used in any suitable power application. As the demand for load or power is increased, the engine output is increased by increasing the fuel and subsequent quantity of air. This in turn, results in an increase in the temperature within the engine. As the air is forced through the nozzle guide vane assembly 64 against the gas producer turbine 62, the increased temperature of the air causes the thermal expansion of the surrounding components. Since the components of the nozzle guide vane assembly 64 and the nozzle case 66 to which they are mounted are comprised of different materials, they also have different rates of thermal expansion and, therefore, grow at different rates. As the components grow, forces are created that react against adjacent components. Structural compensation for these forces must be provided in order to increase the life and efficiency of the gas turbine engine.

For example the nozzle case 66 is made of steel or other metal which will expand at a preselected rate of thermal expansion when the temperature is increased. Since the mounting ring 84 is made of ceramic material, the relative expansion between it and the nozzle case 66 is not equal. Since the metal component will tend to expand or grow more than the ceramic components, a sliding action between the two components would normally be the expected result. Sliding action between the respective components, be they metal or ceramic, is highly undesirable since it tends to cause degradation of the surface of the components. This, in turn, results in surface induced flaws which will ultimately result in catastrophic failure of the components, primarily the ceramic components.

In order to compensate for this action, the only point of contact between the metallic nozzle case 66 and the ceramic mounting ring 64 occurs in the area of the projections 91 and the receptacles 72 in which they are received. The contact between the projections and the receptacles occurs between the first arcuate surface 110 of the ceramic balls 108 and the groove 82 that is defined in the first sidewall 76 of the receptacle 72 and the second arcuate surface 112 of the pin 108 and the groove 100 that is defined in the first sidewall 94 of the projection. The only other point of contact occurs between the roller 116 and the third sidewalls 80 and 98 of the respective receptacles and projections. Being so configured, the relative movement between the projections and the receptacles occurs through areas of rolling contact.

The same principle may be applied to relative motion as a result of thermal expansion between components of similar material. For example, the individual segments 152 of the segmented mounting ring 150 disclosed in FIGS. 5–7 are all comprised of ceramic material. Contact between the individual segments occurs through the pin 168 that is positioned within aligned grooves 160 defined by the individual segments. While the components are comprised of the same material and their rate of thermal expansion is substantially the same, any growth that takes place as a result of thermal expansion will occur between arcuate surfaces which will result in rolling contact thus eliminating sliding contact between the components.

In view of the foregoing, it is readily apparent that the structure of the present invention provides an improved mounting for ceramic nozzle guide vanes or other components having dissimilar, preselected rates of thermal expansion. Since all of the relative movement occurs through an arcuate interface between the components, the sliding action and, therefore, the surface degradation is substantially eliminated and with it the possibility of component failure.

Other aspects, objects and advantages of this invention can be obtained from a study of the drawings, the disclosure and the appended claims.

We claim:

1. A mounting apparatus for ceramic nozzle guide vanes, comprising:

a metallic nozzle case having a plurality of receptacles formed in an end face thereof;

a ceramic mounting ring having a plurality of nozzle guide vanes defined thereby and a plurality of axially extending projections, said mounting ring engaging with said nozzle case in a manner wherein the projections are positioned within the respective receptacles; and means for retaining the axial projections within the receptacles, said means for retaining including a rolling interface between the axial projections and the receptacles.

2. The mounting apparatus as set forth in claim 1 wherein the nozzle guide vanes are defined by a plurality of arcuate segments having a connecting portion formed on an outer circumferential surface thereof, said segments being portioned adjacent one another to form a generally circular nozzle guide vane assembly.

3. The mounting apparatus as set forth in claim 2 wherein the ceramic mounting ring is defined by a plurality of arcuate segments each having a connecting portion defined thereby, each of said connecting portions being in engagement with the connecting portions defined by the nozzle guide vane assembly to secure the nozzle guide vane segments thereto.

4. The mounting apparatus as set forth in claim 1 wherein the end face defined by the nozzle case is a circular, radially extending end face that defines three receptacles that are positioned 120 degrees apart from one another.

5. The mounting apparatus as set forth in claim 1 wherein the receptacles formed in the nozzle case open onto an outer circumferential surface of the nozzle case and have a first sidewall that defines a groove that extends in a substantially radial direction, a second, generally planar sidewall that is spaced from and generally parallel to the first sidewall and a third sidewall that extends between the first and second sidewalls.

6. A mounting apparatus for a nozzle guide vane assembly, comprising:

a nozzle case positioned axially along a centerline of an engine and having a radially extending end face defining at least three radially disposed receptacles equally spaced thereon, said nozzle case being constructed of a material having a preselected rate of thermal expansion;

a plurality of nozzle guide vane segments, each segment having a connecting portion defined on an outer circumferential surface, said nozzle guide vane segments being constructed of a material having a preselected rate of thermal expansion less than that of said nozzle case;

a mounting ring having an inner diameter that defines a plurality of connecting portions and a plurality of axially extending projections, said connecting portions being engaged with the connecting portions of the nozzle guide vanes to secure the nozzle guide vanes thereto and said axially extending projections being positioned within the respective receptacles formed in said nozzle case, said mounting ring being constructed of a material having a preselected rate of thermal expansion that is substantially equal to that of the nozzle vane segments; and means for retaining the axial projections within the receptacles, said retaining means being constructed of a material having a preselected rate of thermal expansion that is substantially equal to that of the nozzle vane segments and including a rolling interface between the axial projections and the receptacles.

7. The mounting apparatus as set forth in claim 6 wherein the receptacles formed in the nozzle case open onto an outer circumferential surface and have a first sidewall having a radially extending groove formed therein, a second axially extending sidewall and a third sidewall positioned between said first and second sidewalls.

8. The mounting apparatus as set forth in claim 7 wherein the projections formed on the mounting ring include a first axially extending sidewall having a radially extending groove, a second axially extending sidewall and a third sidewall positioned between said first and second sidewall, each of said projections being positioned within the respective receptacles with the groove formed in the first sidewall thereof in alignment with the groove formed in the first sidewall of the receptacle.

9. The mounting apparatus as set forth in claim 8 wherein the second sidewall of the projection is positioned in spaced parallel relationship to the second sidewall of the receptacle a preselected distance.

10. The mounting apparatus as set forth in claim 9 wherein the retaining means includes a roller member that is sufficient for positioning within the aligned grooves defined by the respective receptacles and projections, said roller member having a preselected diameter that maintains a preselected distance between the first sidewalls of the respective projection and the receptacle that is larger than the preselected distance between the respective second sidewalls thereof to restrict the axial movement of the projection with respect to the receptacle.

11. The mounting apparatus as set forth in claim 10 wherein the third sidewall of the projection is positioned in spaced, parallel relationship to the third sidewall of the receptacle.

12. The mounting apparatus as set forth in claim 11 wherein the retaining means includes a roller that is positioned between the respective third sidewalls of the receptacle and the projection in bridging contact therewith.

13. The mounting apparatus as set forth in claim 6 wherein each retaining means includes a cage member that has a radially positioned inner portion that mounts the pin member and the roller and is positionable within the receptacle and a radially positioned outer portion that is connected to an annular positioning ring that has a diameter encompassing the nozzle case to maintain the positioning of each retaining means within the respective receptacles.

14. The mounting apparatus as set forth in claim 8 wherein the nozzle case is constructed of a metallic material and the nozzle guide vanes, the mounting ring and the retaining means are constructed of ceramic material.

15. A mounting apparatus for a nozzle guide vane assembly, comprising:

a nozzle case positioned axially along a centerline of an engine and having a radially extending end face defining at least three radially disposed receptacles equally spaced thereon, said receptacles formed in the nozzle case open onto an outer circumferential surface and have a first sidewall having a radially extending groove formed therein, a second axially extending sidewall and a third sidewall positioned between said first and second side wall and said nozzle case being constructed of a material having a preselected rate of thermal expansion;

a plurality of nozzle guide vane segments, each segment having a connecting portion defined on an outer circumferential surface, said nozzle guide vane segments being constructed of a material having a preselected rate of thermal expansion less than that of said nozzle case;

a mounting ring having an inner diameter that defines a plurality of connecting portions and a plurality of axially extending projections, said connecting portions being engaged with the connecting portions of the nozzle guide vanes to secure the nozzle guide vanes thereto and said axially extending projections being positioned within the respective receptacles formed in said nozzle case, said mounting ring being constructed of a material having a preselected rate of thermal expansion that is substantially equal to that of the nozzle vane segments; and means for retaining the axial projections within the receptacles, said retaining means being constructed of a material having a preselected rate of thermal expansion that is substantially equal to that of the nozzle vane segments.

* * * * *